US007992667B2

(12) United States Patent
Rennie

(10) Patent No.: US 7,992,667 B2
(45) Date of Patent: Aug. 9, 2011

(54) OIL COOLING AND FILTERING SYSTEM, KIT AND APPARATUS

(76) Inventor: David Wayne Rennie, Windsor (CA)

( * ) Notice: Subject to any disclaimer, the term of this patent is extended or adjusted under 35 U.S.C. 154(b) by 997 days.

(21) Appl. No.: 11/888,969

(22) Filed: Aug. 3, 2007

(65) Prior Publication Data

US 2008/0035544 A1 Feb. 14, 2008

Related U.S. Application Data

(60) Provisional application No. 60/836,252, filed on Aug. 8, 2006.

(51) Int. Cl.
*B62D 61/02* (2006.01)
*F01M 11/03* (2006.01)

(52) U.S. Cl. ..... 180/219; 210/167.02; 210/167.04; 210/167.06; 210/186; 210/196; 210/251; 210/525; 210/253; 210/335; 210/416.5; 123/196 A; 123/196 AB; 184/6.24

(58) Field of Classification Search ..... None
See application file for complete search history.

(56) References Cited

U.S. PATENT DOCUMENTS

| | | | | | |
|---|---|---|---|---|---|
| 1,408,822 | A | * | 3/1922 | Mosher | 210/341 |
| 1,849,042 | A | * | 3/1932 | Rogers et al. | 210/186 |
| 1,861,805 | A | * | 6/1932 | Lentz | 210/440 |
| 2,076,935 | A | * | 4/1937 | Burckhalter | 210/132 |
| 2,448,711 | A | * | 9/1948 | Hallett | 174/387 |
| 2,473,032 | A | * | 6/1949 | Le Clair | 210/340 |
| 2,492,704 | A | * | 12/1949 | Lentz | 210/333.1 |
| 2,679,320 | A | * | 5/1954 | Walton | 210/102 |
| 2,781,859 | A | * | 2/1957 | Warren | 180/229 |
| 3,741,342 | A | * | 6/1973 | Maddalozzo | 184/6.4 |
| 3,777,847 | A | * | 12/1973 | Lawless | 184/109 |
| 3,830,289 | A | * | 8/1974 | Olson | 165/51 |
| 3,900,401 | A | * | 8/1975 | Oliver et al. | 210/238 |
| 3,914,176 | A | * | 10/1975 | Holmes | 210/132 |
| 4,108,617 | A | * | 8/1978 | Frantz | 96/114 |
| 4,171,729 | A | * | 10/1979 | Shibata | 180/229 |
| 4,295,964 | A | * | 10/1981 | Preisler | 210/130 |
| 4,324,213 | A | * | 4/1982 | Kasting et al. | 123/196 A |
| 4,423,708 | A | * | 1/1984 | Sweetland | 123/196 AB |
| 4,445,587 | A | * | 5/1984 | Hillman | 180/229 |
| 4,497,293 | A | * | 2/1985 | Takagi et al. | 123/196 A |
| 4,524,733 | A | * | 6/1985 | Schmidt | 123/196 A |
| 4,552,662 | A | * | 11/1985 | Webster et al. | 210/232 |
| 4,615,800 | A | * | 10/1986 | Stifelman et al. | 210/132 |
| 4,640,341 | A | * | 2/1987 | Ozawa | 165/41 |

(Continued)

FOREIGN PATENT DOCUMENTS

| | | |
|---|---|---|
| CA | 1 147 273 | 5/1983 |

(Continued)

*Primary Examiner* — Robert James Popovics

(57) ABSTRACT

An adapter apparatus is provided for use in mounting two oil filter cartridges on an engine. The adapter apparatus includes a manifold for interconnecting the oil filters, and for allowing oil to flow in series through the oil filters and an engine. The manifold includes a metal manifold block having an outer face, an inner face, and at least one lateral edge with a plurality of cooling fins thereon. The manifold block has a plurality of hollow flow passages formed therein to route oil therethrough. Two sleeve fittings are attached to the manifold block, and each of the sleeve fittings has male threads formed on an outer surface thereof. Each of the sleeve fittings threadably receives one of the oil filters thereon. The apparatus also includes inlet and outlet tubes attached to the block body, for respectively routing oil to and away from the adapter apparatus.

18 Claims, 12 Drawing Sheets

U.S. PATENT DOCUMENTS 4,662,470 A * 5/1987 Fujisawa et al. ..... 180/219
4,672,932 A * 6/1987 Schmidt ..... 123/196 A
4,831,980 A 5/1989 Nasu et al.
4,971,171 A * 11/1990 Yamada et al. ..... 180/68.1
5,014,775 A * 5/1991 Watanabe ..... 165/167
5,039,406 A * 8/1991 Whittington ..... 210/167.02
5,060,716 A * 10/1991 Heine ..... 165/47
5,236,043 A * 8/1993 Armbruster et al. ..... 165/167
5,244,036 A * 9/1993 Michl ..... 165/300
5,298,158 A * 3/1994 Anderson ..... 210/167.04
5,351,664 A * 10/1994 Rotter et al. ..... 123/196 AB
5,363,823 A 11/1994 Gittlein
5,378,266 A * 1/1995 Elamin ..... 96/114
5,406,910 A * 4/1995 Wallin ..... 123/41.33
5,653,206 A 8/1997 Spurgin
5,701,853 A 12/1997 Takahashi
5,718,281 A * 2/1998 Bartalone et al. ..... 165/41
5,740,772 A * 4/1998 Bluma ..... 123/196 AB
5,753,107 A * 5/1998 Magnusson et al. ..... 210/109
5,809,963 A * 9/1998 Saito ..... 123/195 C
5,853,575 A * 12/1998 Wydra et al. ..... 210/136
5,887,561 A * 3/1999 Spurgin ..... 123/196 AB
5,967,111 A * 10/1999 Hedman ..... 123/196 A
5,988,265 A * 11/1999 Marthaler ..... 165/51
6,139,741 A * 10/2000 McGibbon ..... 210/323.1
6,261,448 B1 * 7/2001 Merchant et al. ..... 210/184
6,474,289 B1 * 11/2002 Lilly et al. ..... 123/198 D
6,485,636 B1 * 11/2002 Moss ..... 210/117
6,581,297 B1 * 6/2003 Ginder ..... 34/79
6,746,600 B2 * 6/2004 Nguyen ..... 210/167.06
6,805,729 B2 * 10/2004 Lim et al. ..... 95/135
6,811,686 B1 * 11/2004 Sorce ..... 210/167.06
6,874,708 B2 * 4/2005 Reetz, III ..... 239/575
6,991,725 B2 * 1/2006 Frerichs et al. ..... 210/249
6,994,150 B1 * 2/2006 Kline ..... 165/41
6,994,784 B2 * 2/2006 Jainek ..... 210/149
7,033,513 B2 * 4/2006 Riggins et al. ..... 210/805
7,077,228 B1 * 7/2006 White ..... 180/219
7,097,696 B2 * 8/2006 Salzman et al. ..... 96/121
7,179,390 B1 * 2/2007 Layton ..... 210/767
7,228,837 B2 * 6/2007 Smith ..... 123/196 R
7,294,262 B2 * 11/2007 Tadlock ..... 210/232
D562,429 S * 2/2008 Morris ..... D23/209
7,387,210 B2 * 6/2008 Burrows et al. ..... 210/443
7,516,727 B2 * 4/2009 Ueshima et al. ..... 123/195 R
RE40,721 E * 6/2009 Desai et al. ..... 210/253
7,886,710 B2 * 2/2011 Tomaru ..... 123/196 R
7,931,290 B2 * 4/2011 Walser ..... 280/293
2002/0125183 A1 * 9/2002 Chaney et al. ..... 210/234
2004/0182566 A1 * 9/2004 Jainek ..... 165/300
2004/0238423 A1 * 12/2004 Schmitt ..... 210/137
2005/0023200 A1 * 2/2005 Ueshima et al. ..... 210/168
2005/0103697 A1 * 5/2005 Magnusson et al. ..... 210/235
2005/0133463 A1 * 6/2005 Kirchner ..... 210/767
2005/0139403 A1 * 6/2005 Gokan et al. ..... 180/68.4
2005/0173317 A1 * 8/2005 Schmitt ..... 210/109
2006/0113240 A1 * 6/2006 Burrows et al. ..... 210/420
2006/0124532 A1 * 6/2006 Magnusson et al. ..... 210/420
2006/0254971 A1 * 11/2006 Tubby et al. ..... 210/235
2007/0158258 A1 * 7/2007 Blaze et al. ..... 210/323.1
2008/0035544 A1 * 2/2008 Rennie ..... 210/167.04
2008/0093275 A1 * 4/2008 Brown ..... 210/86
2008/0121582 A1 * 5/2008 Morris ..... 210/455
2008/0128345 A1 * 6/2008 Sotiriades ..... 210/184

FOREIGN PATENT DOCUMENTS

EP 0969185 1/2000

* cited by examiner

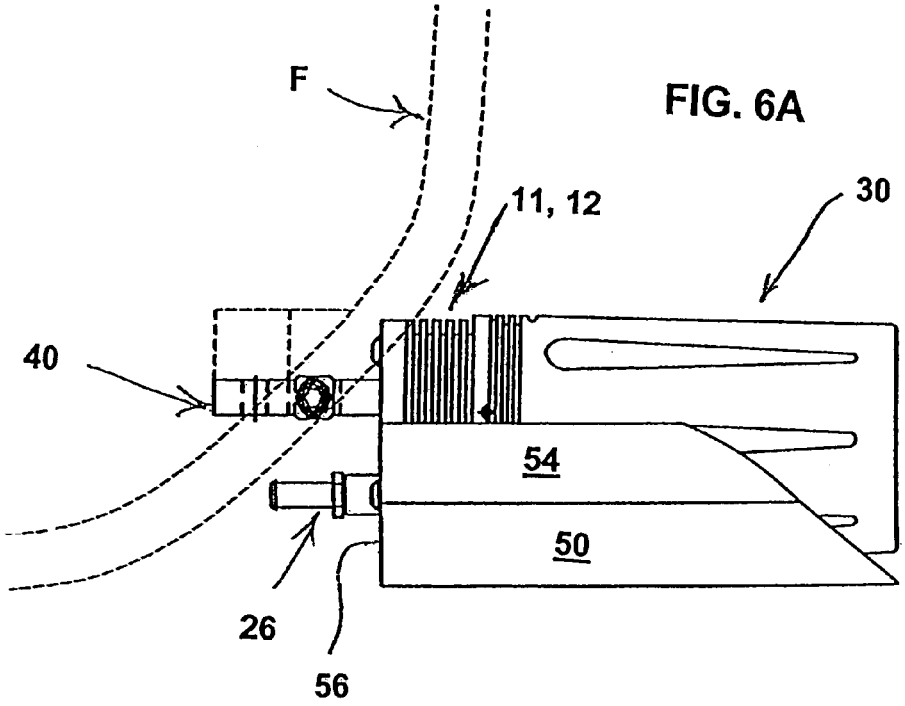
FIG. 6A
FIG. 6B
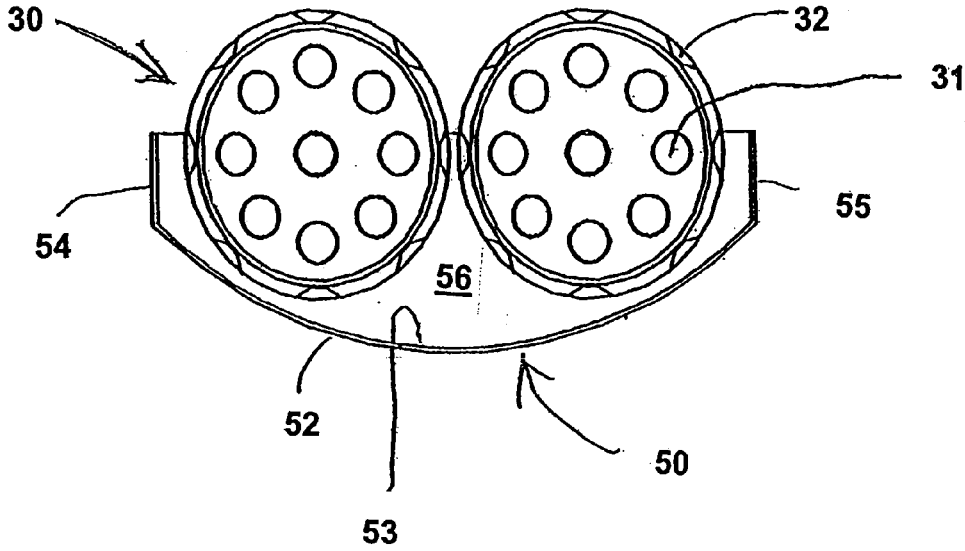

OIL COOLING AND FILTERING SYSTEM, KIT AND APPARATUS

CROSS-REFERENCE TO RELATED APPLICATIONS

The present application claims priority under 35 U.S.C. 119(e), based on U.S. provisional patent application 60/836,252, filed 8 Aug. 2006. The entire disclosure of this priority document, including specification, claims, and drawings, is incorporated by reference herein.

BACKGROUND OF THE INVENTION

1. Field of the Invention

The present invention relates to a dual-filtration oil system, kit and apparatus which may be used on air-cooled or liquid-cooled engines in vehicles, as well as in some other applications such as in industrial settings, etc. The primary application for the present invention is on an internal combustion engine. More particularly, the present invention relates to a visually attractive dual-filtration oil filter system, kit and apparatus, including filter covers and manifolds which are designed to maximize the cooling effect obtained from air flowing around components of the system, for improving cooling efficiency and enhancing aesthetic appearance.

2. Description of the Background Art

Certain types of vehicles have air-cooled engines. Motorcycles, such as those manufactured by the Harley Davidson Motorcycle Company of Milwaukee, Wis., have large displacement, four stroke, air-cooled engines. It is well known that these engines have an oil pump that circulates oil through the engine, to lubricate the components and to carry away the accumulated heat of combustion and friction. To assure proper circulation and lubrication, it is imperative that proper oil pressure be maintained. A significant drop in oil pressure can result in engine damage.

It is well known with engines of this type that they have replaceable "spin-on" oil filters that are removably attached to the engine. Typically, a filter mount fitting is provided on a portion of the engine block, the filter mount fitting including a threaded port to accommodate a threaded bore in the filter. The threaded port of the filter mount fitting has an axial bore, through which oil from the filter is returned to the engine for re-circulation by the oil pump.

The filter has a threaded center bore formed therein, such that the filter can be installed on or removed from the threaded port on the engine at appropriate times. One or more openings are disposed about the port on the engine block, through which engine oil, delivered by the oil pump, is supplied to the filter. The filter removes harmful contaminants from the oil, and also helps to dissipate heat from the oil, mostly via convection heat transfer as air flows around exterior surfaces of the filter.

With continuing reference to air-cooled engine of the type described above, the primary cooling of this type of engine is carried about by air movement past integral cooling fins provided on the cylinder block. When the vehicle is moving, forced convection heat transfer occurs to carry away heat, provided that the ambient air moving past the fins is sufficiently cool.

When the vehicle is stopped with its engine running, and particularly in elevated ambient conditions such in extreme heat and humidity, the temperature of the oil may rise to such a high level that oil pressure may drop to a dangerously low level. In those circumstances, the operator of the vehicle must turn off the engine, or risk damage to internal engine components. The foregoing is particularly true for vehicles which may be stopped in traffic, or involved in slow moving, stop-and-go traffic conditions. Under these conditions and in the engines of this type described above, insufficient cooling takes place to maintain proper oil pressure.

A drawback of prior oil filtering and cooling systems is that their close proximity to the engine does not allow for efficient cooling of the oil. Heat from the engine is transferred to the immediate environment surrounding the engine, particularly in stagnant conditions when the motorcycle is not moving. This increases ambient temperature conditions about the oil cooler, thus affecting the efficiency thereof.

A number of different devices are known for utilizing airflow to cool oil during or close to a time while the oil is being passed through a filter. Some examples of known devices include U.S. Pat. No. 5,363,823 to Gittelin, U.S. Pat. No. 4,831,980 to Nasu et al., U.S. Pat. No. 5,653,206 to Spurgin, U.S. Pat. No. 5,701,853 to Takahashi, European Patent EP 0969185AL to Schanz and Canadian Patent 1,147,273 to Preisler et al.

Although the known devices have some utility for their intended purposes, a need still exists in the art for an improved dual oil filtering system, kit, and apparatus for use on internal combustion engines. In particular, there is a need for an improved dual-filtration oil filtering system, kit, and apparatus for an engine that is visually attractive, and efficiently cools the oil so that the engine will not overheat or suffer damage.

SUMMARY

The present invention has been developed to overcome limitations and disadvantages of known oil cooling and filtration systems, and to generally fulfill a need in the art for an improved oil cooling and filtering system that may be used on a vehicle or in various industrial settings, which is visually attractive and which includes manifolds which enhance the cooling effect obtained from air flow around the filters, for improved cooling efficiency.

The present invention is intended to promote oil cooling in air-cooled or liquid-cooled engines, in order to help protect such engines from abnormal wear, and also to reduce the operating temperature of the engine. It is a feature of one embodiment of the invention that the apparatus appear stylized and complimentary to the vehicle on which it is installed, in other words, that it have an enhanced aesthetic appearance.

According to one exemplary embodiment of the invention, an adapter apparatus is provided for use in mounting a pair of oil filter cartridges on an air-cooled or liquid-cooled engine. In this first illustrative embodiment, the adapter apparatus includes a manifold for supportively connecting the two oil filter cartridges, and for allowing oil to flow sequentially through and between the oil filter cartridges and an engine when installed on the engine and operational.

In this first embodiment, the manifold includes a metal block body having an outer face, an inner face, and at least one lateral edge with a plurality of integral cooling fins extending outwardly thereon. The block body has a plurality of hollow flow passages formed therein to route oil therethrough.

The apparatus according to the first embodiment also includes first and second hollow sleeve fittings attached to the block body, where each of the sleeve fittings has male threads formed on a respective outer surface thereof. A portion of each of the sleeve fittings extends outwardly from the outer face of the block body, and the sleeve fittings are respectively configured to threadably receive one of the oil filter cartridges thereon.

The apparatus according to the first embodiment also includes an inlet tube and an outlet tube respectively attached to the block body and in fluid communication with selected passages of the block body, for respectively routing oil to and away from the adapter apparatus.

Optionally, an apparatus according to an embodiment of the invention may still further include a pair of filter covers or caps for placement covering the filters, each cover having at least one opening at one axial end thereof for receiving air flow and at least one opening near an opposite end thereof for discharging an air flow. Another optional feature which may be provided as a component of this embodiment is a hinged adjustment mechanism which permits selective pivoting adjustment of an orientation of the apparatus in relation to a support member.

One more optional component which the apparatus may further include a is a shield scoop for placement beneath the filters, for channeling additional air flow towards the covers, filters and manifolds, and for protecting these components from damage from stones and other foreign objects.

Accordingly, it is an object of the present invention to provide a oil filter and cooling apparatus which ameliorates some of the above problems inherent in the conventional oil cooler assembly with the integrated oil filter.

It is another object of the present invention to provide an oil filtering and cooling apparatus that may be mounted on a vehicle frame.

It is another object of the present invention to provide a method and apparatus for adapting an engine to use dual oil filter cartridges.

For a more complete understanding of the present invention, the reader is referred to the following detailed description section, which should be read in conjunction with the accompanying drawings. Throughout the following detailed description and in the drawings, like numbers refer to like parts.

Further scope and applicability of the present invention will become apparent from the detailed description given below. However, it should be understood that the detailed description and the specific examples, while indicating exemplary embodiments of the invention, are given by way of illustration only, since various changes and modifications within the spirit and scope of the invention will become apparent to those skilled in the art from this detailed description.

BRIEF DESCRIPTION OF THE DRAWINGS

An illustrative embodiment of the present invention of the oil cooling and air filtering apparatus will be better understood when consideration is given to the detailed description of the accompanying drawings, wherein like elements bear like reference numerals and where:

FIG. 6A is a side plan view of the apparatus of FIGS. 1A-4, with filter cartridges mounted thereon and with filter covers over the filters, and also showing the air scoop disposed below the filter cartridges.

FIG. 6B is a front plan view of the apparatus of FIG. 6A.

DETAILED DESCRIPTION

Figure 1A:
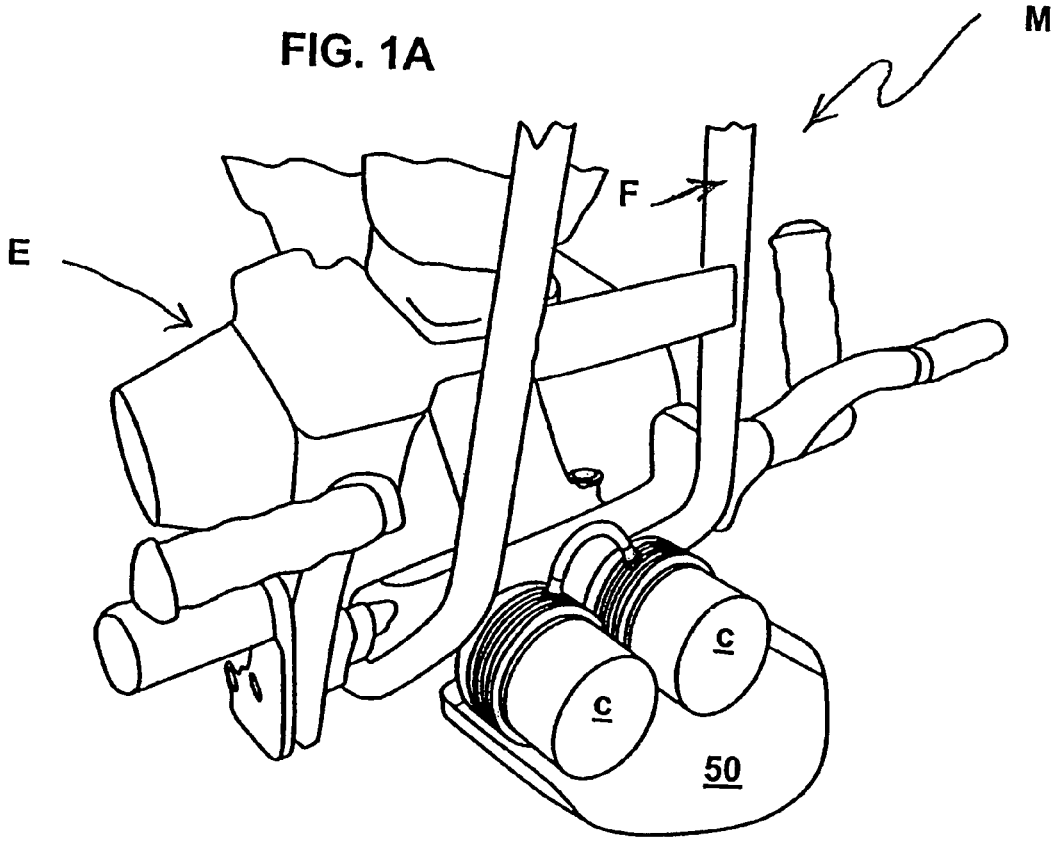
FIG. 1A is an environmental perspective view of lower front portion of a motorcycle frame having an oil filter adapter apparatus according to a first illustrative embodiment of the present invention, where the apparatus is shown with two oil filter cartridges mounted thereon, with an accompanying air scoop below the filters.
Figure 1B:
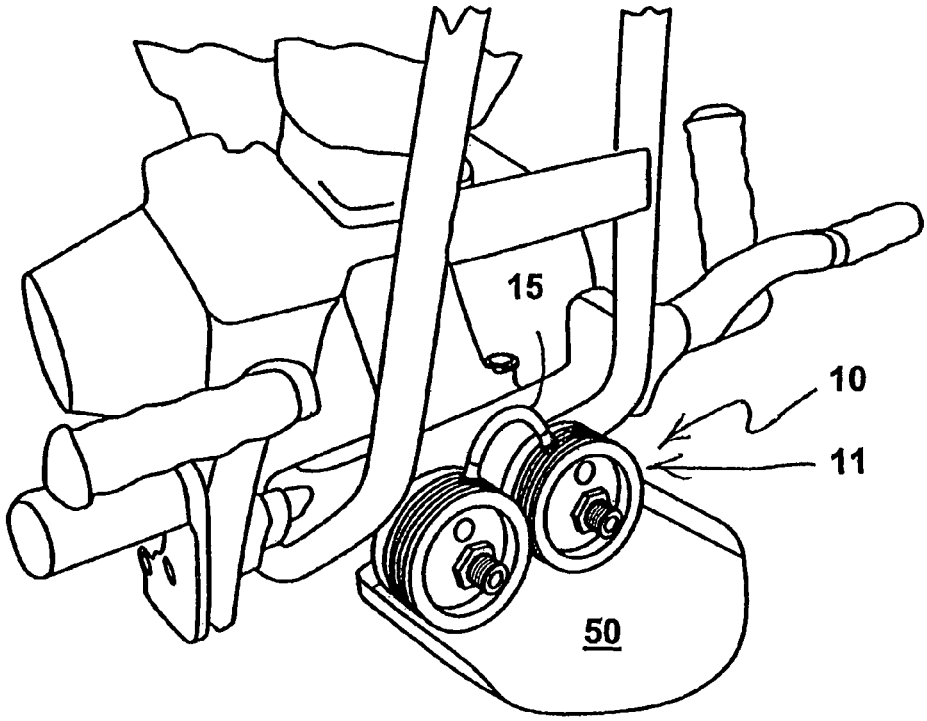
FIG. 1B is an environmental perspective view similar to FIG. 1A, but with the filter cartridges removed for illustrative purposes.

It should be understood that only structures considered necessary for clarifying the present invention are described herein. Other conventional structures, and those of auxiliary components of the system, are assumed to be known and understood by those skilled in the art.

With specific reference to the drawings, and in particular to FIGS. 1A, 1B, 2A-2C and 3 thereof, an illustrative embodiment of a new oil cooling and air filtering apparatus is shown generally by the reference numeral 10.

In a first illustrative embodiment of the present invention, an improved oil cooling and filtering apparatus 10, is configured and adapted to be mounted on a frame portion F of a motorcycle M having an air-cooled engine E. The apparatus 10 is adapted for use with two standard "spin-on" type oil filter cartridges C. The oil filter cartridges C (also referred to herein as "oil filters"), while used in conjunction with the adapter apparatus 10 of the present invention, are commercially available and are not considered a part of the invention, per se. The adapter apparatus 10 allows two conventional filter cartridges C to be connected in series when installed on a vehicle engine.

In the embodiment of FIGS. 1A, 1B, 2A-2C and 3, the apparatus 10 includes a manifold 11 made up of two finned manifold block bodies 12, 12 which are interconnected by a connector tube 15. In this first illustrative embodiment, manifold 11 is provided for supportively connecting the two oil filter cartridges C, and for allowing oil to flow sequentially through and between the oil filter cartridges and the engine E, when the apparatus 10 is installed on the engine and operational.

Figure 2A:
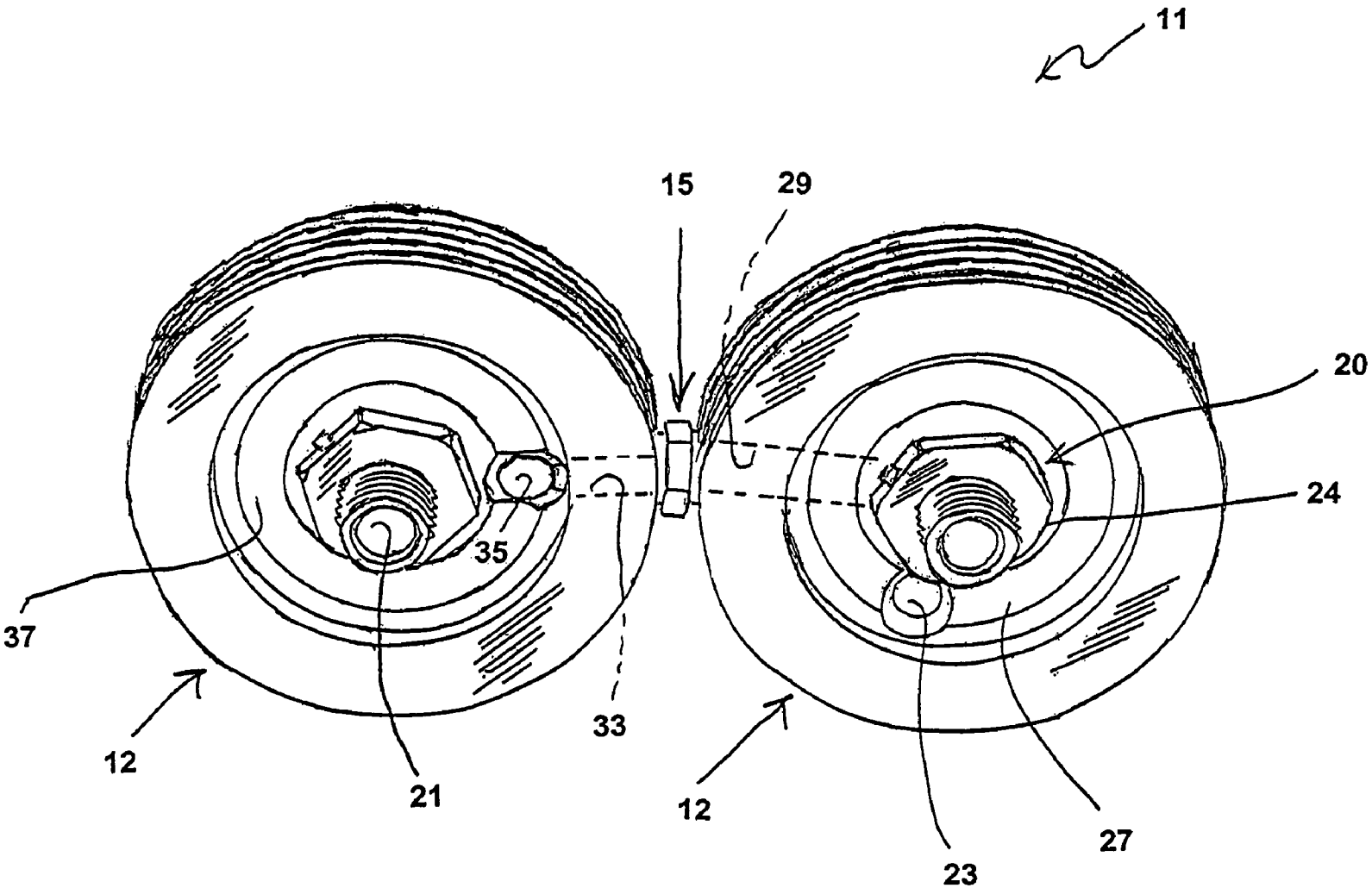
FIG. 2A is a perspective view of a manifold assembly, which is a component of the apparatus of FIGS. 1A-1B.
Figure 2B:
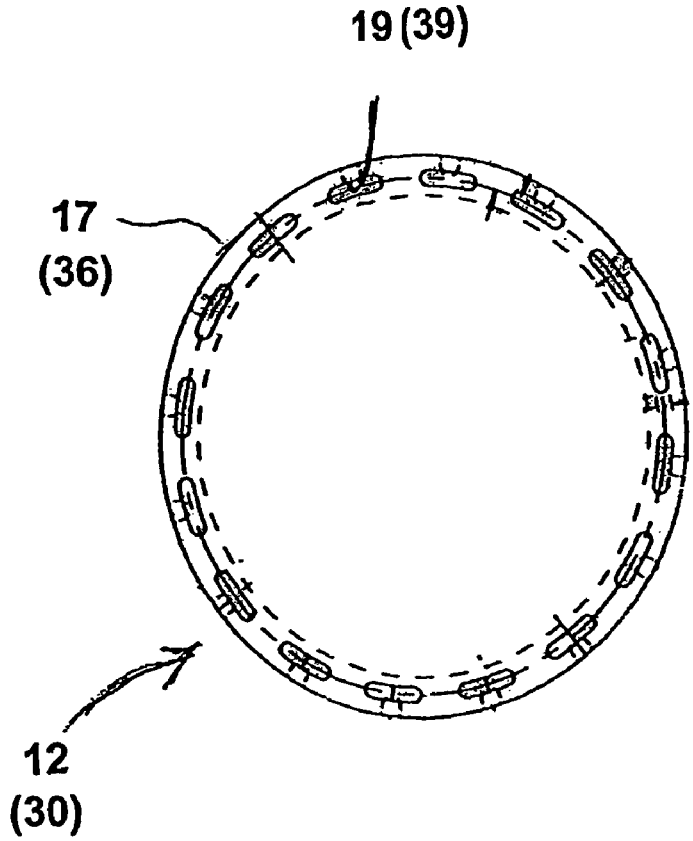
FIG. 2B is an end plan view of an alternate embodiment of a manifold block having transverse air passages formed therethrough.

In this first embodiment, as noted, the manifold 11 includes two metal block bodies 12 (also referred to herein as manifold blocks 12), interconnected by a connector tube 15. The manifold 11 may also include a disc-shaped adapter plate 18 for each of the manifold blocks 12. Each of the block bodies 12 has an outer face 13, an inner face 14, and at least one lateral edge 16 with a plurality of integral cooling fins 17 extending outwardly thereon. Each block body 12 has a plurality of hollow flow passages formed therein to route oil therethrough. These flow passages will be described in detail below. Referring to FIG. 2B, it will be seen that in one optional embodiment of the invention, each of the cooling fins 17 may have a plurality of transverse air passages 19 formed therethrough and extending in a circular pattern around the periphery of the block body 12, in order to promote air flow therethrough during forward movement of the vehicle, for added cooling effect.

It will be understood from the description contained herein that the two block bodies 12 may, alternatively be joined together as a unit, and combined with the adapter plates 18 to form an alternate manifold which is a single integral unit and which may be formed of cast metal.

The apparatus 10 according to the first embodiment also includes first and second hollow sleeve fittings 20, 20, with a respective sleeve fitting being attached to each block body 12, where each of the sleeve fittings 20 has male threads 22 formed on a respective outer surface thereof. Each sleeve fitting 20 has a hollow central passage 21 formed therethrough, and also has a hex nut 24 formed at a medial portion thereof. A portion of each sleeve fitting 20 extends outwardly from the outer face 13 of the block body 12, and each one of the sleeve fittings 20 is respectively configured to threadably receive one of the oil filter cartridges C thereon. The hex nut 24 portions of the sleeve fittings 20 may be magnetized, so as to attract errant or loose metallic particles present within the engine oil. This allows the user of the vehicle to monitor the engine oil or other fluid for metallic particles indicative of engine wear and tear, at such time as the cartridges C are removed during oil changes.

The apparatus 10 according to the first embodiment also includes an inlet tube 26 and an outlet tube 28 respectively attached to the manifold 11 and in fluid communication with selected passages of the manifold 11, for respectively routing oil to and from the adapter apparatus. It will be understood that when installed on a vehicle M, the inlet and outlet tubes are respectively connected to the oil circulating system of the engine, either by replacing a single spin-on filter with a block designed to channel the oil to the apparatus 10, or where internal filtration is used as on some Harley-Davidson models, by connecting appropriate flexible and heat-tolerant tubing to the conventional oiling system of the vehicle, while taking care to route such tubing away from exhaust components or other vehicle components which are likely to become hot during use.

Optional Components

Figure 3:
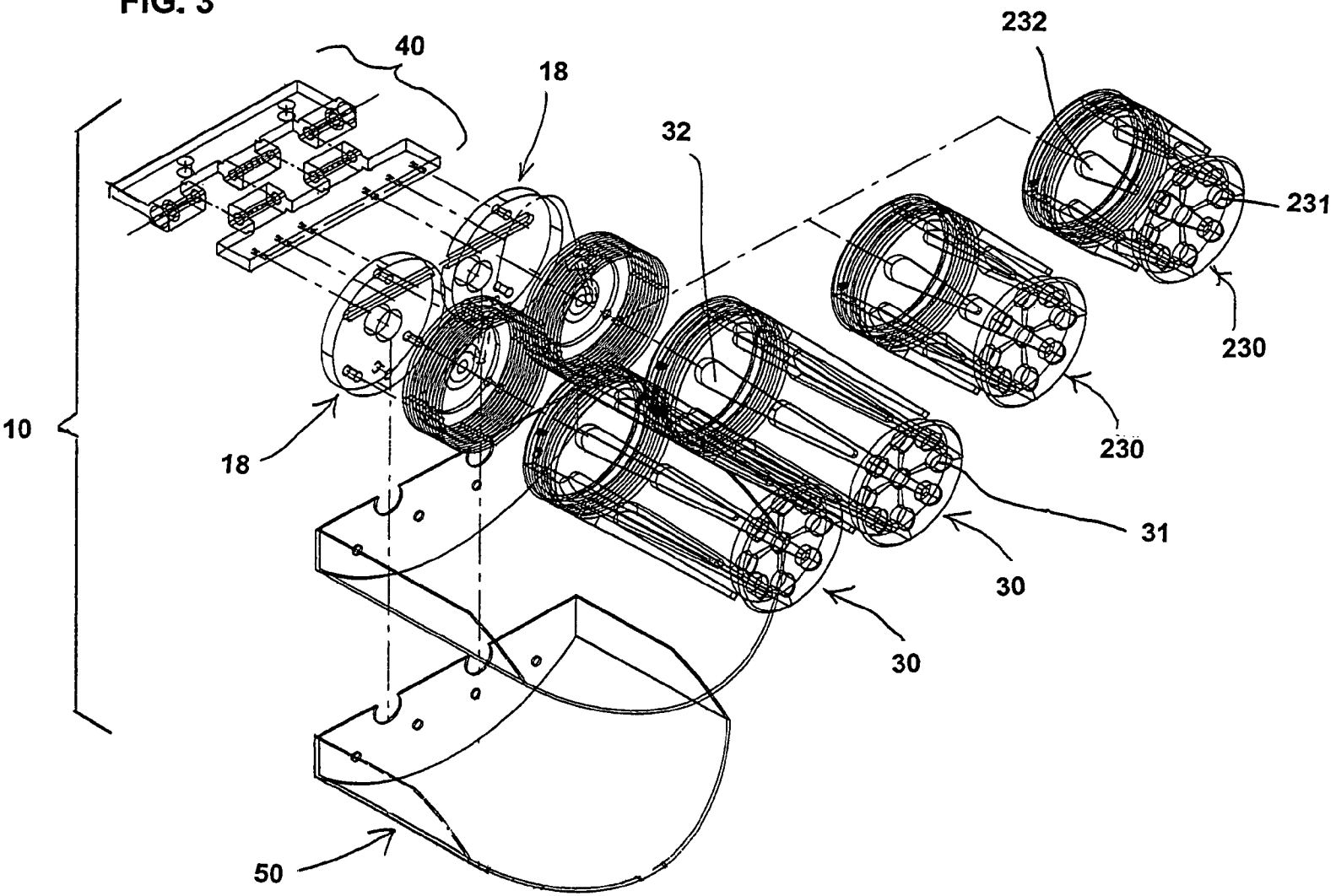
FIG. 3 is an exploded perspective view of the apparatus of FIGS. 1A-1B, also showing two alternate sets of optional filter covers which are omitted from FIGS. 1A-1B, and showing an air scoop disposed below the filter cartridges.

Optionally, as shown in FIG. 3, an apparatus 10 according to an embodiment of the invention may still further include a pair of filter covers or caps 30, 30 for placement covering the filters. (An alternate set of filter covers 230, 230 is also shown in FIG. 3. This alternate set of filter covers 230, 230 may be used for a shorter length filter than the first set of filter covers 30, 30.) Each filter cover 30 or 230, where used, has at least one air inlet opening 31 or 231 formed therein at one axial end thereof, for receiving air flow, and at least one air outlet opening 32 or 232 formed therein near an opposite end thereof for discharging air flow.

Another optional feature, which may be provided as a component of the apparatus 10 according to this embodiment, is a hinged adjustment mechanism 40 (see FIG. 3), which permits selective pivoting adjustment of an orientation of a main portion of the apparatus 10 in relation to a support member such as the frame F.

Figure 5A:
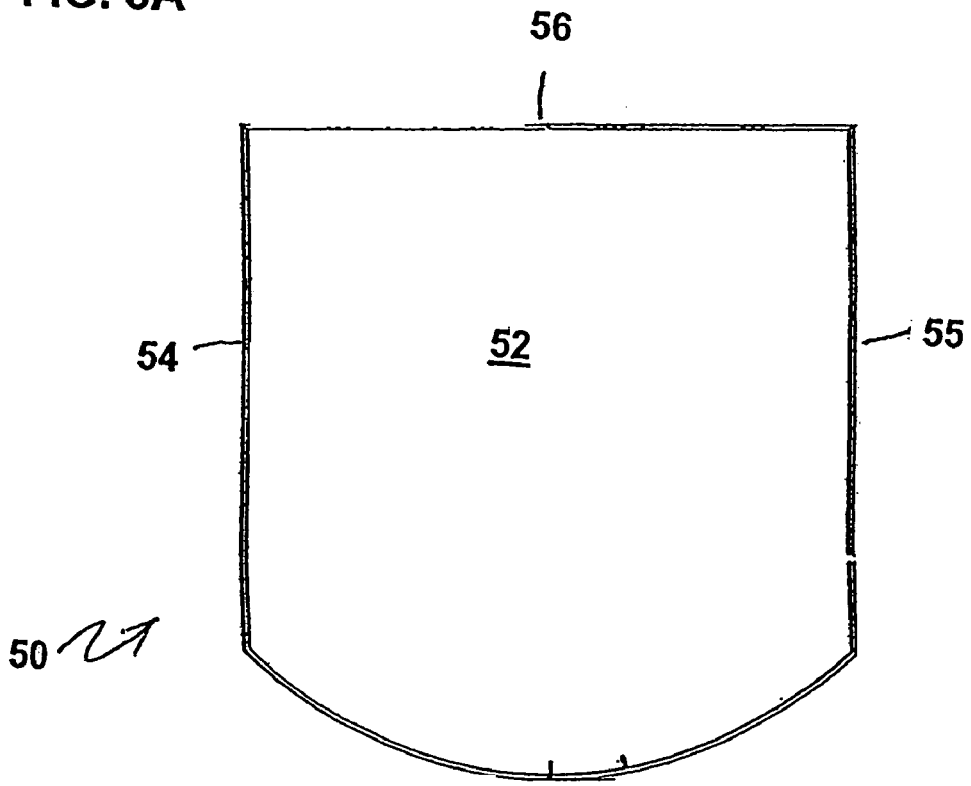
FIG. 5A is a top plan view of a scoop which is a component of the apparatus of FIGS. 1A-4.
Figure 5B:
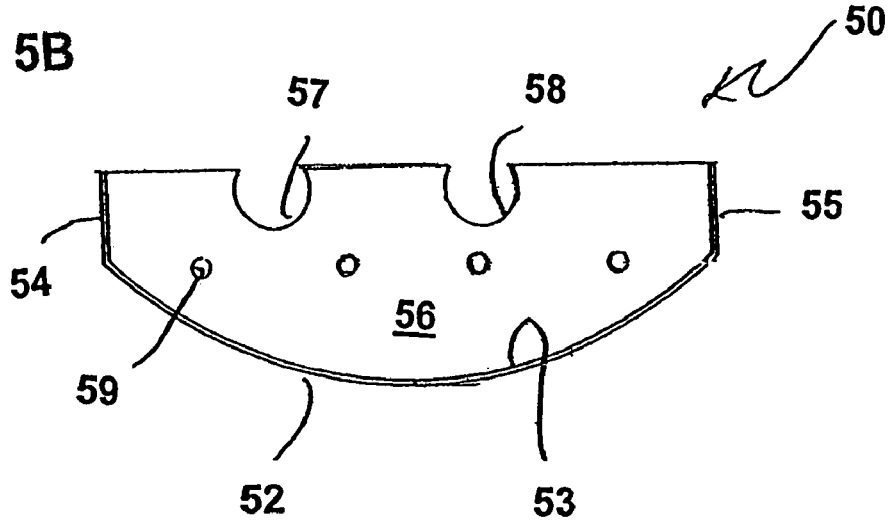
FIG. 5B is a front plan view of the scoop of FIG. 5A.

Alternatively, if desired, the manifold blocks 12 may be attached to the frame F using a support plate member 240 (FIG. 5) instead of the hinge member 40, where the plate member 240 is used in combination with a pair of disc-shaped adapter plates 18. The plate member 240, where used, may have a plurality of holes formed therethrough, as shown, to enable mounting of the apparatus 10 to a motorcycle frame F. In one optional embodiment of the present invention, a support post and finned housing, for supportively housing a voltage regulator, may be mounted to the plate member 240 using the holes formed therein.

One more optional component which the apparatus may further include a is a shield or scoop 50 for placement beneath the filter cartridges C, for routing and channeling additional air flow towards the covers 30, filter cartridges C and manifold blocks 12 during forward movement of the vehicle M, and for protecting these components from damage from stones and other foreign objects which may bounce up from a road surface.

The apparatus 10, according to the illustrated embodiment, also includes two adapter plates 18, for supportive placement behind the respective manifold blocks 12. The apparatus 10 may also include optional height adjuster arms (not shown) to enable a user to adjust the height of the air scoop 50, relative to the engine E of the vehicle M.

Flow Path Through the Apparatus

A path of oil flowing through the filter cartridges C and the manifold 11 will now be described with reference to FIGS. 2A, 2C and 4. Oil first enters the apparatus 10 through the inlet fitting 26, where it passes through a first manifold block 12 through a hollow inlet opening 23, and enters an annular trench 27 formed in the outer face 13 of the first manifold block.

The oil then enters the first filter cartridge C, where it is forced through a cylindrical filter element 60 therein, flowing inwardly from the outside of the filter element to the central portion thereof. The oil then flows into and through a central bore formed in the hollow sleeve fitting 20, to a lateral outlet passage 29 formed in the first manifold block.

From the lateral outlet passage 29, the oil then enters the connector tube 15, and passes over to the second manifold block, entering an inlet passage 33 extending part way through the second manifold block and communicating with another hollow inlet opening 35, and into an annular trench 37 of the second manifold block 12.

The oil then enters the second filter cartridge C, where it is forced through the cylindrical filter element thereof, once again flowing inwardly from the outside of the filter element to the central portion thereof. The oil then flows into and through a central bore formed in the hollow sleeve fitting 20 of the second manifold block 12, passes through the center of the manifold block 12, and enters the outlet fitting 28, from which it returns to the engine E via flexible tubing.

The first filter cartridge C is used to trap larger size impurities, while the second filter cartridge C captures smaller size impurities which have already passed through the first filter cartridge. The filter cartridges C are each mounted to a respective finned manifold block 12. The oil filter cartridges C do not have to be any particular size and/or diameter, and can range in size from small, medium to large. However, the manifold blocks 12 and the filter covers 30, 230 may be made in any appropriate size to fit different filters, for different applications, as illustrated by the different filter covers 30, 230 shown in FIG. 3.

Figure 7:
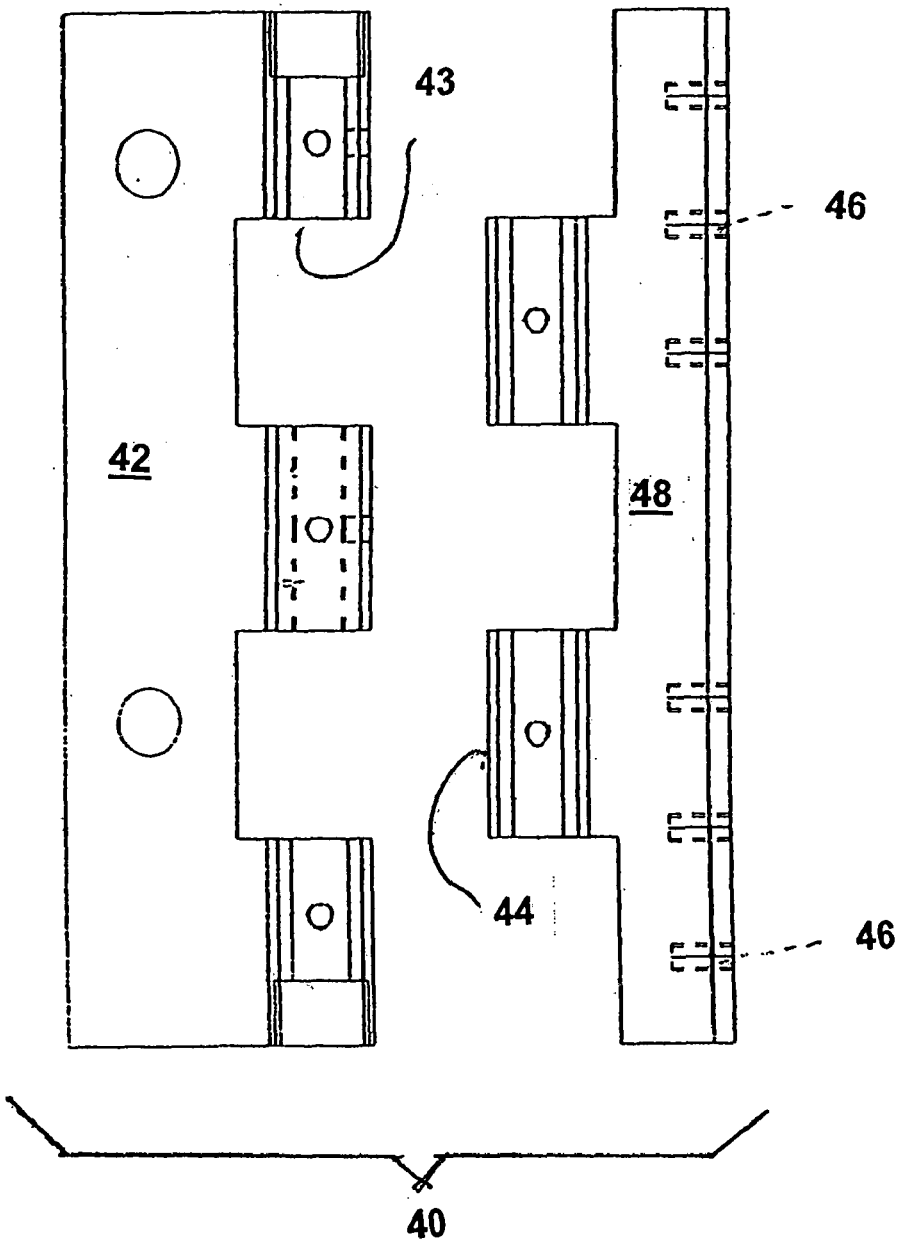
FIG. 7 is a top plan view of a hinge plate which is another component of the apparatus of FIGS. 1A-4.

Referring now to FIGS. 6-7, front and side views of the filter covers 30, attached to the manifold 11 and the air scoop 50 are shown. FIG. 6 also illustrates a phantom view of a portion of the motorcycle frame F. The filter covers 30 can be affixed to the finned manifold blocks 12 via press fitting, interlocking threads, or any other appropriate connection. The filter covers 30 may have an ornamental characteristic for enhancing the aesthetic appearance of the apparatus 10. The respective inlet and outlet openings 31, 32 of the filter covers 30 may be evenly spaced apart in distinct patterns (as shown), or randomly arranged on the exposed faces of the filter covers 230, so as to allow for a maximum amount of air flow to the filters.

In another embodiment of the filter cover 30, the outermost front face of the filter cover can be completely open and unobstructed, allowing for an even greater amount of air being transferred to the filter. The filter cover 30 can be fashioned to portray popular designs, logos, or portraits. In a further embodiment the filter cover 30, 230 may be equipped with lighting for night illumination, to further enhance the visual aesthetic appeal of the filter cover 30 or 230.

With reference to FIG. 6A, a side view of the filter cover 230 is shown, along with the manifold block 12, adapter plate 18, air scoop 50, hinge plate 40 and an inlet fitting 26. The finned filter covers 230 are placed over the filter cartridges C within a concave portion of the air scoop 50, and the apparatus 10 is secured/affixed in place via attachment of a rear portion of the hinge plate 40 to a portion of the frame F. The length of the finned filter covers 30, 230, as well as the length and width of the scoop 50 may vary from large, medium, to small to correspond with the corresponding length, width, and depth of the corresponding filter cartridge C. The finned filter covers 30, 230 can have a plurality of teardrop-shaped openings 32 formed therein and evenly spaced around the circumference of the cover 30, as shown in FIGS. 3 and 7. The filter cover 30 or 230 is removably attached to a corresponding manifold block 12 via a threaded connection therebetween or other fastening mechanism as previously described, and in one usable arrangement of components, the manifold block 12 may be connected to the frame F via an adapter plate 8 and corresponding drill holes 26 connecting the adapter plate to the hinge plate 40 via a plurality of suitable fastening devices.

With reference to FIGS. 3 and 6-9, one embodiment of the air scoop 50 is shown. The scoop may also function as a drain pan to direct and contain the flow of oil when the filter cartridges C are removed from the manifold 11 during an oil change performed while the engine E is shut off. The air scoop 50 comprises a concavely curved base plate 52 and two integral, substantially planar vertical side panels 54, 55 attached to opposite lateral sides of the base plate. The air scoop 50 is configured to define a catch basin 53 therein above the base plate 52. The scoop 50 also includes a substantially flat vertical back plate 56 having a dome-shaped outline shape, as shown in FIG. 9, where the side and bottom edges of the back plate are integrally attached to the side panels 54, 55 and the base plate 52, respectively.

The dome-shaped back plate 56 may have two substantially circular cutouts 57, 58 formed therein, to allow for the inlet and outlet fittings 26, 28 of the manifold block 11 to pass rearwardly beyond the air scoop 50. Further, the back plate 56 may have additional holes 59 drilled into the back plate 56 to allow for the manifold blocks 12 or the adapter plates 18 to be affixed to the air scoop via screws, nuts and bolts or similar fasteners. Although the present specification discloses the air scoop 50 as shown and described herein, the air scoop can be of any desired shape, and is not limited to being shaped as described herein.

The adapter apparatus 10 may be hingedly connected to the vehicle frame via a hinge 40, which allows the angle to be adjusted so as to vary the amount of airflow toward and around the apparatus, while the air scoop 50 may additionally function as a stone guard and fairly providing protection from rocks, debris, and wind. Pivotal movement of the apparatus 10 also acts as a manual thermostat, i.e. as a manner of manually adjusting operating temperatures of the oil. The air scoop 50 can be adjusted using mechanical means, such as a manual lever (not shown) or similar means, such as an electrical motor or hydraulic system, to raise and lower the adapter apparatus 10. The air scoop 50 may also acts as a oil catch pan for oil changes thus, protecting other parts of the vehicle from spillage. The air scoop 50 can be easily wiped clean which is easier and more convenient than wiping off the engine and other vehicle parts. Also, if desired, the scoop 50 may have a drain opening defined therein (not shown). The air scoop 50 as shown can be made of aluminum and finished in chrome to be aesthetically pleasing and to match the rest of the system. However, the air scoop 50 can be manufactured from any other material which may be suitable and is not limited to being made of aluminum.

Figure 4:
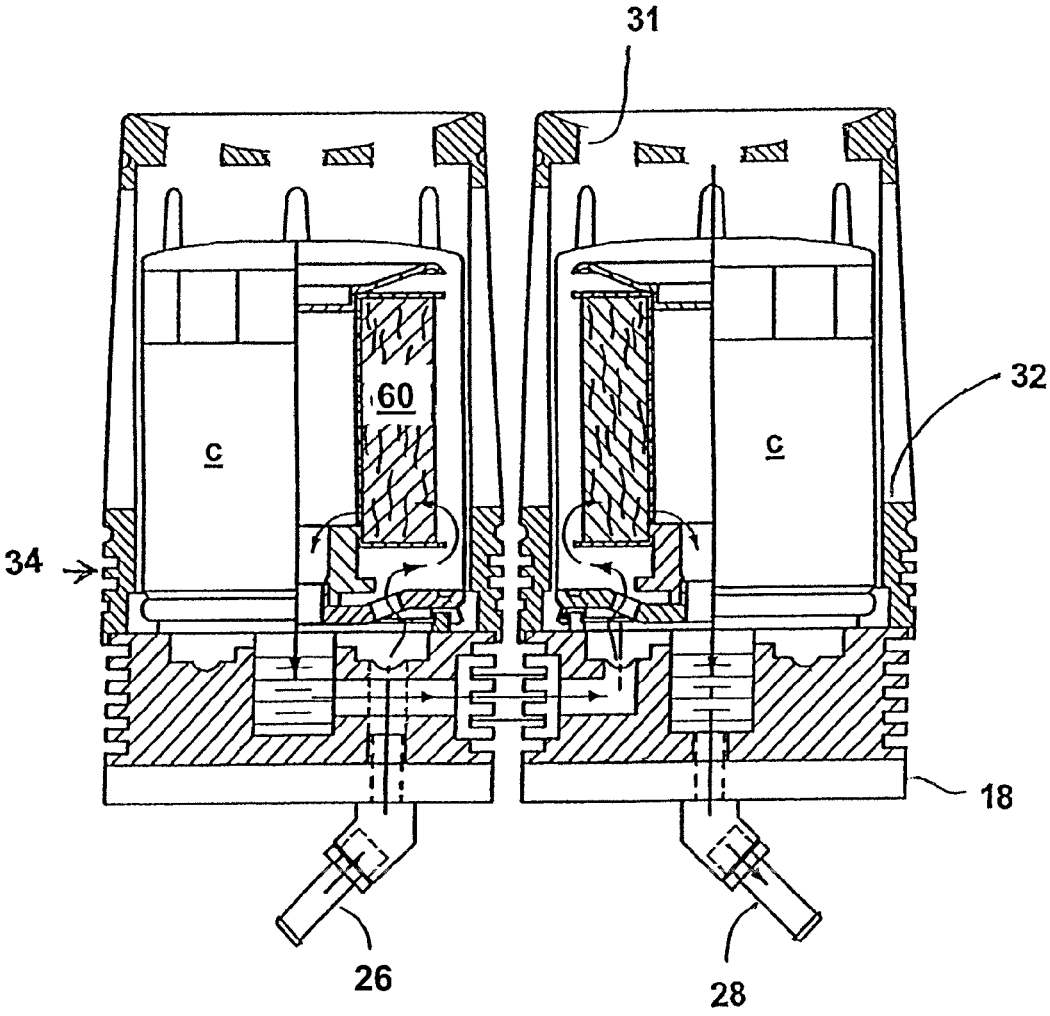
FIG. 4 is a cross-sectional view of the apparatus of FIGS. 1A-3 with filter cartridges mounted thereon and with filter covers over the filters, showing a flow path through the apparatus and through the filter cartridges.

With reference to FIGS. 4 and 6, one embodiment of a filter cover 30 is shown, with the filter cartridge C disposed therein, and with the filter cover 30 attached to a front portion of the manifold block 12. The filter cover 30 is configured to help route air flow over the filter cartridge C, thereby helping to cool the oil as air flows over the system. The filter cover 30 may have annular fins 34 that extend around the circumference thereof. The annular fins 34, where used, provide an added advantage wherein they help to draw heat off the filter especially at low speeds, stop and go or slow moving traffic. The fins 17 of the manifold blocks 12, and also the fins 34 of the filter covers 30 may have transverse air passages 19 or 39 formed therein (FIG. 2B) that extend in a direction parallel to an axis of the associated oil filter cartridge C, where the air passages 19 are arranged in a circular pattern extending around the circumference of an outer portion of the fin in which the passages are formed, as shown in the drawing.

Figure 2C:
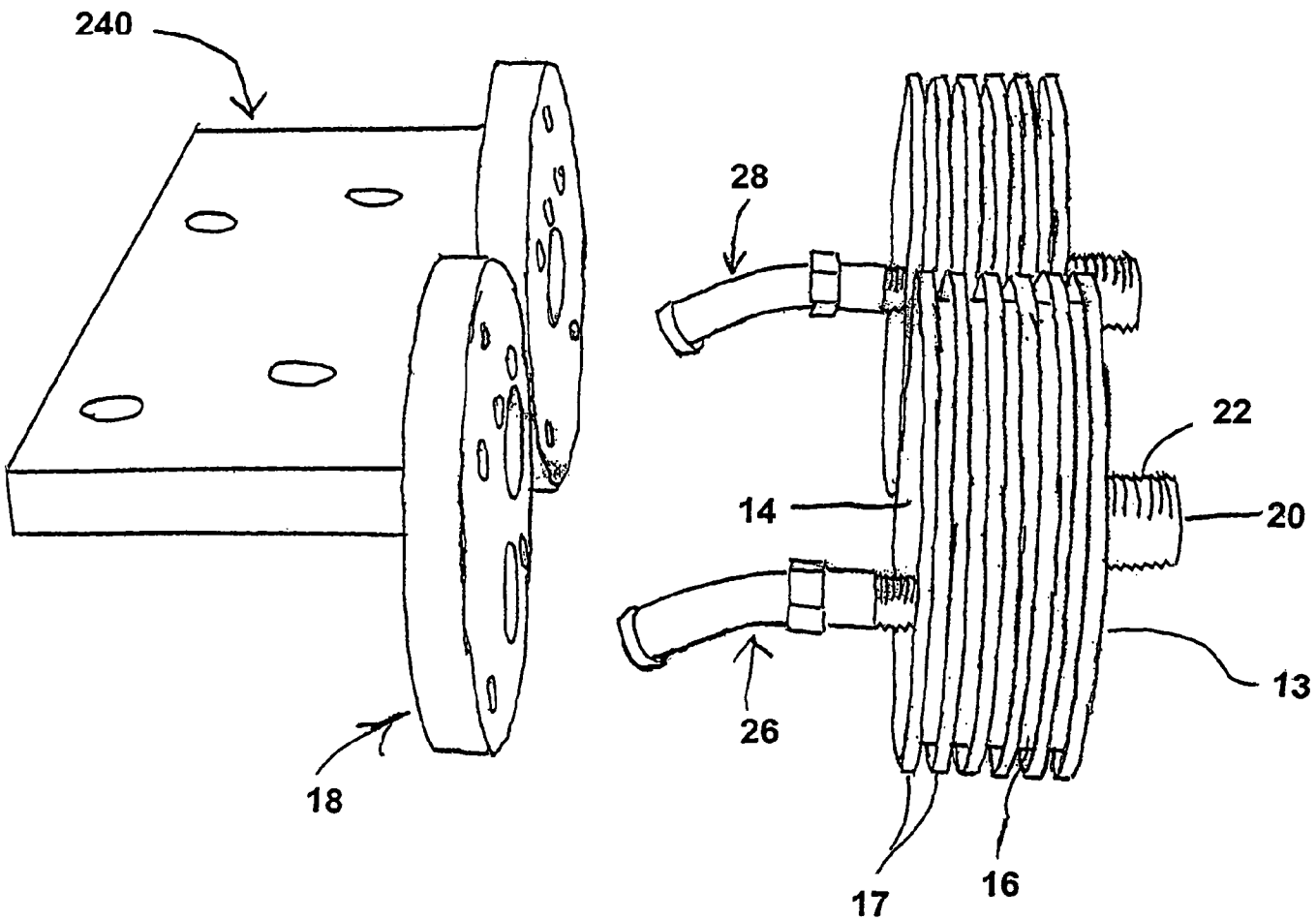
FIG. 2C is a side perspective view of the manifold assembly of FIG. 2A, also showing a pair of adapter plates mounted to a support plate, where the adapter plates are shown spaced away from the manifold blocks for purposes of illustration.

Now referring to FIG. 2C, the adapter plate 18 is shown. The adapter plate 18 is substantially circular in shape, and the diameter of the adapter plate is similar to that of the manifold block 12. The adapter plate as shown has a number of pre-drilled holes 46 formed therein, to allow ensure that the adapter plate 18 may be secured to the manifold block 12. Additionally, the adapter plate 18 may be formed with a circular opening in the center of the plate to receive a protruding portion of the manifold cooler block 12. The adapter plate 18 as shown can be manufactured from aluminum, but is not limited to such material and may be manufactured from any other suitable material as well.

Referring to FIGS. 3 and 7, the two-piece hinge plate 40 is shown. The hinge plate 40 attaches to the motorcycle frame F in a lower front portion thereof, and in the depicted embodiment, six machine screws 47 are used to hold the two adapter plates 18 to an edge of a hinge plate section 48. The hinge plate 40 consists of two separate and distinct plate sections, with a first plate section 42 having spaces 43 formed therein to receive protruding portions 44 of the second plate section 48, in order to complete the structure of the hinge plate 40. A socket head shoulder bolt 49 (FIG. 6A) is used to pivotally connect the first and second plate sections 42, 48 together. Two stop locks (not shown) are provided in order to keep the socket head shoulder bolts 49 in place at their respective ends of the hinge plate 40. The hinge plate 40 is positioned laterally across the top portion of the adapter plates 18.

Figure 8:
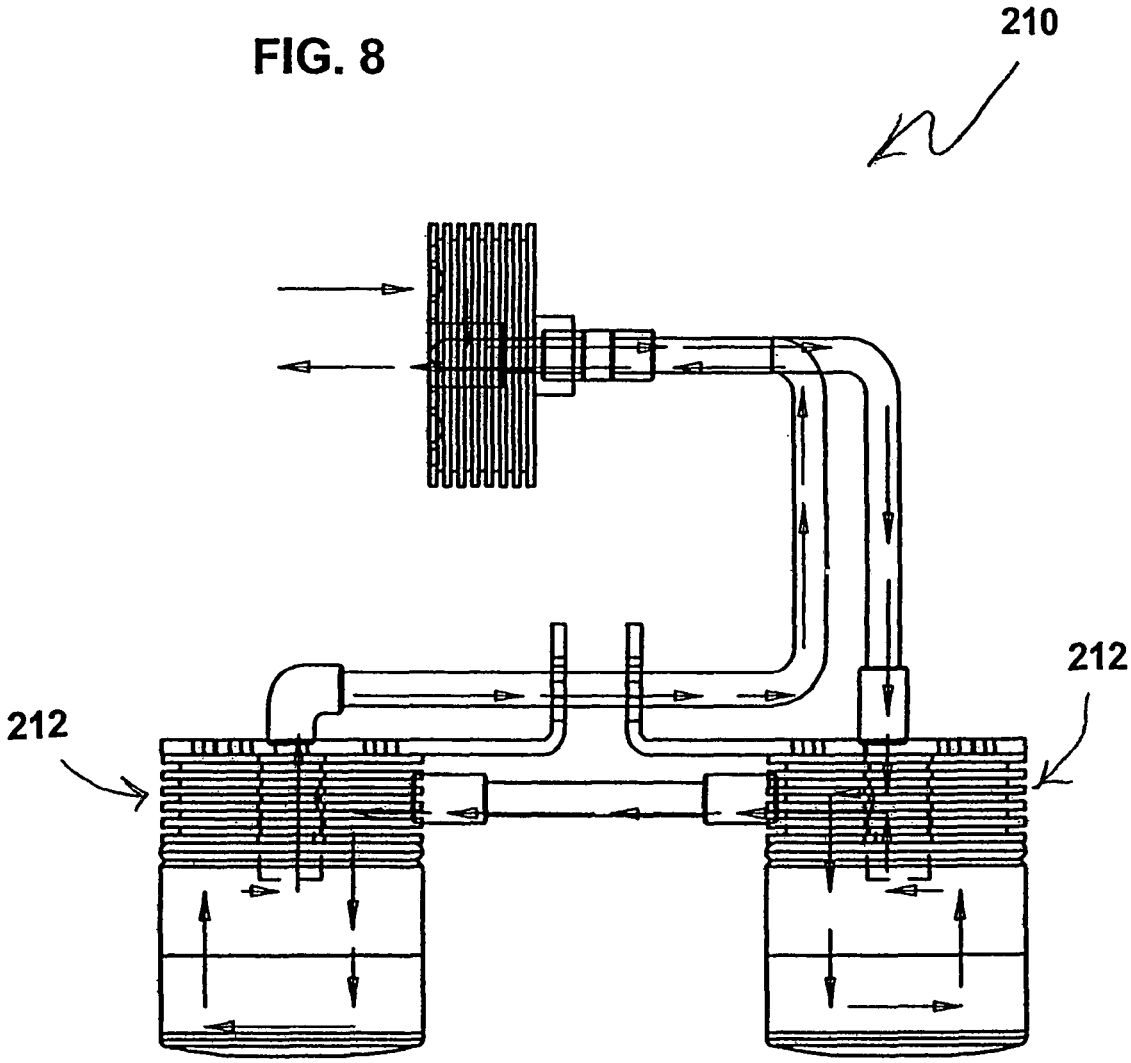
FIG. 8 is a top plan view of an oil filtering and cooling system according to a second illustrative embodiment of the present invention.
Figure 9A:
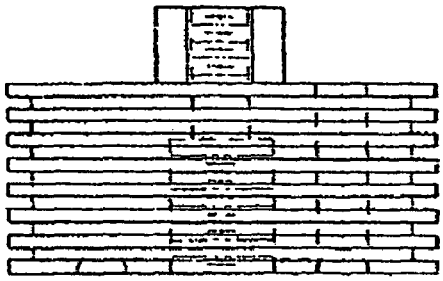
FIGS. 9A-9C illustrate an adapter block which is a component of the embodiment of FIG. 8.
Figure 9B:
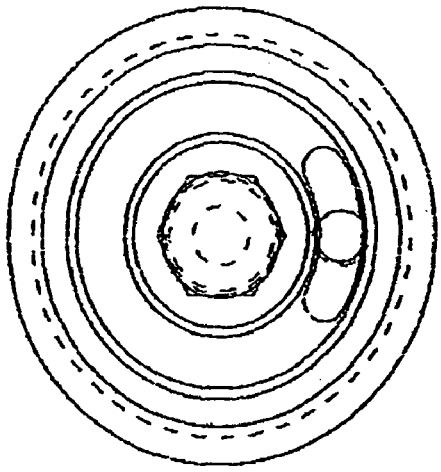
Figure 9C:
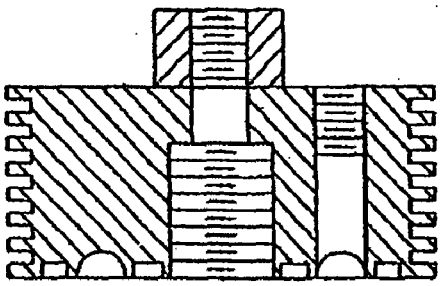
Figure 10:
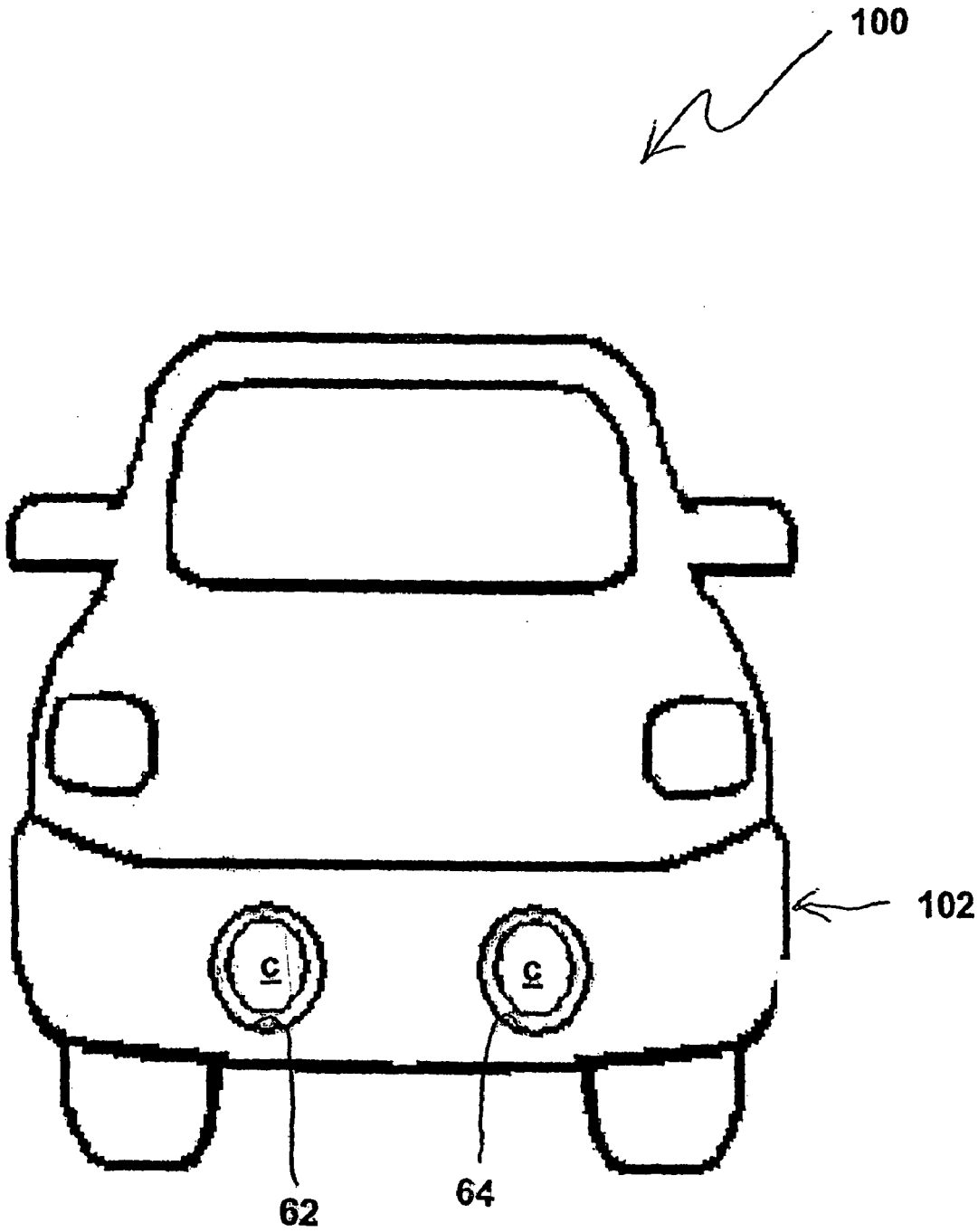
FIG. 10 is a front plan view of a car having an apparatus according to the present invention installed thereon.

FIG. 8 illustrates an embodiment of the invention provided for use on a car, where an adaptor block is used to connect to a point on the engine block where a single spin-on filter cartridge is normally used. FIGS. 9A-9C illustrate the adaptor block in more detail, and FIG. 10 illustrates one possible example of a usable location for the embodiment of FIG. 8 installed on a car body. In the application of FIG. 10, two spaced-apart holes 62, 64 are formed in a front bumper 102 or in a lower trim piece disposed below the front bumper of an automobile 100, and two spaced-apart manifold blocks 212 are disposed behind the holes 62, 64 so that the filter cartridges C may be inserted into the holes and spun on to the respective manifold blocks. (It will be understood that in this embodiment, the bumper 102 will be configured and arranged with suitable access openings formed therein, to permit insertion of a suitable tool to remove the cartridges C as needed for oil changes).

While the apparatus has been described herein in relation to use on a vehicle such as a car or motorcycle, primarily in relation to cooling oil, it will be understood that the apparatus 10 may also be used to cool transmission fluid, particularly automatic transmission fluid.

In another, alternative application of the present invention, an apparatus 10 according to the present invention may be connected to a CNC oil pump machine which cools the oil that passes through the filters of the apparatus 10. By affixing the system to the CNC oil pump machine the resulting effects are that there is a cooler factory, cleaner air circulation, cooler machines, computer, and electrical equipment, energy saving, less electrical and machinery breakdown, and less contamination of oils and coolants and longer oil and coolant life. Accordingly, the invention can be used as a cooling mechanism for oil or similar fluids used in industrial CNC machinery or the like.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. In combination with a motorcycle, an adapter apparatus for use in mounting a pair of oil filter cartridges on an engine, said adapter apparatus comprising:

a manifold for supportively connecting said oil filter cartridges and for allowing oil to flow sequentially in series through and between said oil filter cartridges and an engine when installed on the engine and operational; and an inlet tube and an outlet tube respectively attached to said manifold and in fluid communication with selected passages said manifold, for respectively routing oil to and away from said adapter apparatus;

wherein said manifold comprises:

a metal block body having an outer face, an inner face, and at least one lateral edge with a plurality of integral cooling fins extending outwardly thereon, said block body having a plurality of hollow flow passages formed therein to route oil therethrough; and first and second hollow sleeve fittings attached to said block body, each of said sleeve fittings having male threads formed on a respective outer surface thereof, a portion of each of said sleeve fittings extending outwardly from said outer face of said block body, said sleeve fittings respectively configured to threadably receive one of said oil filter cartridges thereon.

2. The adapter apparatus of claim 1, wherein the manifold comprises separate first and second block bodies and a transfer tube interconnecting an outlet of the first the block body to an inlet of the second block body.

3. The adapter apparatus of claim 2, wherein the manifold further comprises an adapter plate for each of the first and second block bodies.

4. The adapter apparatus of claim 1, further comprising a pivotally adjustable hinge assembly for installation between the manifold and the engine, for allowing an orientation of the apparatus to be selectively pivotally varied, relative to said engine.

5. The adapter apparatus of claim 1, further comprising a scoop which fits below the manifold for routing air flow therepast.

6. The adapter apparatus of claim 1, further comprising a pair of filter covers for placement over the filter cartridges, the filter covers having a plurality of air flow openings formed therein and being removably attachable to the manifold, wherein said filter covers are configured to channel air flow to contact outer surfaces of said oil filter cartridges for promoting additional heat transfer during use when installed on a moving vehicle.

7. The adapter apparatus of claim 6, wherein the filter covers have fins formed radially thereon at a base portion thereof and wherein the fins of both the manifold block and the filter covers have transverse air passages formed therein that extend in a direction parallel to an axis of an associated sleeve fitting.

8. The adapter apparatus of claim 7, wherein the air passages of the fins are arranged in a circular pattern extending around the circumference of an outer portion of each fin in which the passages are formed.

9. The adapter apparatus of claim 1, wherein each of the fins of the manifold blocks has transverse air passages formed therein that extend in a direction parallel to an axis of an associated sleeve fitting.

10. The adapter apparatus of claim 9, wherein the air passages of the fins are arranged in a circular pattern extending around the circumference of an outer portion of each fin in which the passages are formed.

11. An adapter apparatus for use in mounting a pair of oil filter cartridges on an engine, said adapter apparatus comprising:

a manifold for supportively connecting said oil filter cartridges and for allowing oil to flow sequentially in series through and between said oil filter cartridges and an engine when installed on the engine and operational;

a scoop which fits below the manifold for routing air flow therepast;

a pivotally adjustable hinge assembly for installation between the manifold and the engine, for allowing an orientation of the apparatus to be selectively pivotally varied, relative to said engine;

wherein said manifold comprises:

a metal block body having an outer face, an inner face, and at least one lateral edge with a plurality of integral cooling fins extending outwardly thereon, said block body having a plurality of hollow flow passages formed therein to route oil therethrough; and first and second hollow sleeve fittings attached to said block body, each of said sleeve fittings having male threads formed on a respective outer surface thereof, a portion of each of said sleeve fittings extending outwardly from said outer face of said block body, said sleeve fittings respectively configured to threadably receive one of said oil filter cartridges thereon; and an inlet tube and an outlet tube respectively attached to said block body and in fluid communication with selected passages of said block body, for respectively routing oil to and away from said adapter apparatus.

12. A vehicle having the adapter apparatus of claim 11 installed thereon.

13. An adapter apparatus for use in mounting a pair of oil filter cartridges on an engine, said adapter apparatus comprising:

a main support plate having a plurality of openings formed therein;

a first manifold block operatively attached to said main support plate for supportively receiving a first oil filter cartridge thereon and for allowing oil to flow therethrough, said first manifold block comprising a first block body having an outer face, an inner face, and at least one lateral edge with a plurality of integral cooling fins extending outwardly thereon, said first block body having a plurality of hollow flow passages formed therein to route oil therethrough;

a second manifold block attached to said main support plate for supportively receiving a second oil filter cartridge thereon and for allowing oil to flow therethrough, said second manifold block comprising a second block body having an outer face, an inner face, and at least one lateral edge with a plurality of integral cooling fins extending outwardly thereon, said second block body having a plurality of hollow flow passages formed therein to route oil therethrough;

a connector tube interconnecting an outlet of said first block body to an inlet of said second block body;

first and second hollow sleeve fittings attached to said first and second block bodies, respectively, each of said sleeve fittings having male threads formed on an outer surface thereof, a portion of said sleeve fittings extending outwardly from said respective outer faces of said first and second block bodies, respectively, wherein said sleeve fittings are configured to threadably and respectively receive said oil filter cartridges thereon;

an inlet tube attached to said first block body and in fluid communication with selected passages of said first block body for routing oil to said apparatus, and an outlet tube attached to said second block body and in fluid communication with selected passages of said second block body, for routing oil away from said apparatus.

14. The adapter apparatus of claim 13, wherein the manifold further comprises an adapter plate for each of the first and second block bodies.

15. The adapter apparatus of claim 14, further comprising a pivotally adjustable hinge assembly for installation between the manifold and the engine, for allowing an orientation of the apparatus to be selectively pivotally varied, relative to said engine.

16. The adapter apparatus of claim 14, further comprising a scoop which fits below the manifold for routing air flow therepast.

17. The adapter apparatus of claim 14, further comprising a pair of filter covers for placement over the filter cartridges, the filter covers having a plurality of air flow openings formed therein and being removably attachable to the manifold, wherein said filter covers are configured to channel air flow to contact outer surfaces of said oil filter cartridges for promoting additional heat transfer during use when installed on a moving vehicle.

18. The adapter apparatus of claim 14, wherein each of the fins of the manifold blocks has transverse air passages formed therein that extend in a direction parallel to an axis of an associated sleeve fitting.

* * * * *